US010227873B2

(12) United States Patent
Assmann et al.

(10) Patent No.: US 10,227,873 B2
(45) Date of Patent: Mar. 12, 2019

(54) STEAM TURBINE

(71) Applicant: Siemens Aktiengesellschaft, Munich (DE)

(72) Inventors: Ingo Assmann, Erlangen (DE); Thilo Müller, Nuremberg (DE); Tim Neuberg, Nuremberg (DE); Michael Stöbe, Gorlitz (DE)

(73) Assignee: Siemens Aktiengesellschaft, Munich (DE)

( * ) Notice: Subject to any disclaimer, the term of this patent is extended or adjusted under 35 U.S.C. 154(b) by 423 days.

(21) Appl. No.: 14/915,229

(22) PCT Filed: Aug. 12, 2014

(86) PCT No.: PCT/EP2014/067194

§ 371 (c)(1),
(2) Date: Feb. 27, 2016

(87) PCT Pub. No.: WO2015/043815

PCT Pub. Date: Apr. 2, 2015

(65) Prior Publication Data

US 2016/0215623 A1 Jul. 28, 2016

(30) Foreign Application Priority Data

Sep. 30, 2013 (DE) ..... 10 2013 219 771

(51) Int. Cl.
*F01D 1/04* (2006.01)
*F01D 5/14* (2006.01)
(Continued)

(52) U.S. Cl.
CPC ..... *F01D 1/04* (2013.01); *F01D 5/147* (2013.01); *F01D 25/24* (2013.01); *F01K 13/006* (2013.01); *F05D 2220/31* (2013.01)

(58) Field of Classification Search
CPC . F01D 1/04; F01D 25/24; F01D 25/30; F01D 11/00; F01K 7/22; F01K 3/14; F05D 2220/31
See application file for complete search history.

(56) References Cited

U.S. PATENT DOCUMENTS 3,206,166 A * 9/1965 Beldecos ..... F01D 5/08 415/101
7,484,926 B2 * 2/2009 Suga ..... F01D 25/26 415/108

(Continued)

FOREIGN PATENT DOCUMENTS

CN 1971001 A 5/2007
CN 101010488 A 8/2007

(Continued)

OTHER PUBLICATIONS

CN Office Action dated Sep. 27, 2016, for CN patent application No. 201480054078.X.

(Continued)

*Primary Examiner* — Ninh H Nguyen
*Assistant Examiner* — Brian P Wolcott
(74) *Attorney, Agent, or Firm* — Beusse Wolter Sanks & Maire

(57) ABSTRACT

A steam turbine has a single-shell turbine casing and specific inner casings arranged inside the turbine casing. The steam turbine has a turbine casing with an outer wall, a turbine shaft mounted rotatably about a turbine axis in the turbine casing, a first turbine part, and at least one second turbine part which is arranged downstream of the first turbine part in the axial direction of the turbine shaft, wherein the expansion direction for steam conducted through the steam turbine runs from the first turbine part to the second turbine part, wherein between the first turbine part and the second turbine part, a sealing shell is arranged on the turbine casing, (Continued)

in particular on the inner side of the outer wall for rotation therewith, the sealing shell being formed in a sealing manner with respect to the turbine shaft via sealing elements.

13 Claims, 2 Drawing Sheets

(51) Int. Cl.
*F01D 25/24* (2006.01)
*F01K 13/00* (2006.01)

(56) References Cited

U.S. PATENT DOCUMENTS

| | | | |
|---|---|---|---|
| 9,074,480 | B2 | 7/2015 | Ishiguro et al. |
| 2003/0206166 | A1 | 11/2003 | Kamata |
| 2007/0101719 | A1 | 5/2007 | Niizeki |
| 2008/0213085 | A1 | 9/2008 | Deidewig et al. |
| 2008/0260529 | A1 | 10/2008 | Kawakami |
| 2010/0034641 | A1 | 2/2010 | Ikeda et al. |
| 2012/0207595 | A1 | 8/2012 | Roge et al. |
| 2013/0078088 | A1 | 3/2013 | Predmore et al. |
| 2015/0260055 | A1 | 9/2015 | Ishiguro et al. |

FOREIGN PATENT DOCUMENTS

| | | | | |
|---|---|---|---|---|
| CN | 101644174 | A | | 2/2010 |
| CN | 102325964 | A | | 1/2012 |
| DE | 1059926 | B | | 6/1959 |
| DE | 1872434 | U | * | 5/1963 |
| DE | 1872434 | U | | 5/1963 |
| EP | 1752614 | A2 | | 2/2007 |
| EP | 2402565 | A1 | | 1/2012 |
| EP | 2554789 | A1 | | 2/2013 |
| JP | S5022906 | A | | 3/1975 |
| JP | S57119110 | A | | 7/1982 |
| JP | H04008703 | A | | 1/1992 |
| JP | 10089013 | A | | 4/1998 |
| JP | H1089013 | A | | 4/1998 |
| JP | H1089013 | A | * | 4/1998 |
| JP | 5294356 | B2 | | 9/2013 |
| RU | 2351766 | C2 | | 4/2009 |
| RU | 111580 | U1 | | 12/2011 |

OTHER PUBLICATIONS

JP Notice of Allowance dated Jul. 31, 2017, for JP patent application No. 2016-518712.
JP Office Action dated May 8, 2017, for JP patent application No. 2016518712.
RU search report dated Apr. 3, 2018, for RU patent application No. 2016117168.

* cited by examiner

STEAM TURBINE

CROSS REFERENCE TO RELATED APPLICATIONS

This application is the US National Stage of International Application No. PCT/EP2014/067194 filed Aug. 12, 2014, and claims the benefit thereof. The International Application claims the benefit of German Application No. DE 102013219771.3 filed Sep. 30, 2013. All of the applications are incorporated by reference herein in their entirety.

FIELD OF INVENTION

The present invention relates to a steam turbine.

BACKGROUND OF INVENTION

In steam power stations, steam is used as working medium for operating steam turbines. Pressurized water vapor is produced in a steam boiler and flows via pipes into the steam turbine. In the steam turbine, the previously absorbed energy of the working medium is converted into kinetic energy. The kinetic energy is used, for example, to operate a generator which converts the mechanical power generated into electrical power. The expanded and cooled steam then flows into a condenser where the steam condenses by heat transfer in a heat exchanger and is fed again as liquid water by a pump to the steam boiler for heating, evaporating and subsequent superheating. In order to achieve greater and maximum efficiency in the steam power process, the steam power process is being developed to ever greater fresh steam parameters. Said high fresh steam parameters displace the condensation point of the system deeper into the wet steam range and therefore to partial condensation.

Customary steam turbine systems have at least one high-pressure part for maximum efficiency. In addition, a medium-pressure part and one or more low-pressure parts can be used. In the low-pressure part, the temperature of the steam drops very abruptly, as a result of which partial condensation of the steam occurs. However, the low-pressure part is highly sensitive, as far as the wet content of the steam is concerned. If the steam in the low-pressure part of the turbine reaches a wet content of approx. 8 to 10 percent, measures have to be taken to reduce the wet content of the steam to a permissible extent prior to entry into the low-pressure part and during the further expansion in same. One of said measures can be the use of an additional resuperheating and/or drying of the steam. By means of this measure, the steam is again resuperheated and therefore the efficiency of the steam power process is increased at the same time.

For the steam drying/resuperheating, the entire mass flow of steam is completely removed from the turbine and fed again to the steam boiler prior to entry into the middle- or low-pressure part. In the resuperheating, the steam temperature is generally raised again to that of the fresh steam, and therefore the wet content at the expansion end point drops. The steam is subsequently guided back into the turbine system. Without such a resuperheating, the steam turbine system cannot be continuously operated at extremely low exhaust steam pressures (approx. 50 . . . 25 mbar) since water droplets which have condensed out strike against the rotating turbine blades and thereby cause damage to the blading.

In the case of multi-casing steam turbine systems, such a resuperheating/drying of the water vapor can be carried out between the individual turbine sections.

The casing material in the inflow region of the turbine is greatly weakened in the strength properties thereof by the very hot steam, and therefore said casing material can no longer counteract the pressures prevailing in the interior. A thickening of the casing wall is possible only to a limited extent since, in the case of very thick casings, impermissibly high, thermally induced stresses occur in the casing wall as a result of temperature changes. The same temperatures prevail in the region of action with the resuperheated steam, and therefore the casing material is also greatly weakened here. Turbine systems with resuperheating therefore differ from conventional systems by means of two points in the expansion run that are at risk because of extremely high temperatures.

In the case of a single-casing steam turbine with resuperheating, greatly superheated steam is conducted into the turbine at two points. The turbine outer casing is greatly loaded thermally at two points by the temperatures and pressures which occur.

Steam turbines with resuperheating have previously been designed either as two-casing turbine systems, or lower steam parameters have been used such that the single-shell turbine outer casing has not been overloaded.

However, the required parameters which occur frequently lie above the possible parameters of single-shell turbine casings.

SUMMARY OF INVENTION

Starting from the previously described problem in the case of steam turbines, the invention was based on the object of reducing the loading, in particular the temperature loading and pressure loading, of a turbine outer casing of a steam turbine.

This object is achieved by a steam turbine with the features of the independent patent claim. Further features and details of the invention emerge from the dependent patent claims, the description and the drawings.

That is to say, the object of the invention is achieved by a steam turbine with a turbine casing with an outer wall, a turbine shaft mounted rotatably about a turbine axis in the turbine casing, a first turbine part, and at least one second turbine part which is arranged downstream of the first turbine part in the axial direction of the turbine shaft, wherein the expansion direction for steam conducted through the steam turbine runs from the first turbine part to the second turbine part. The first turbine part is advantageously designed as a high-pressure turbine part, the second turbine part is advantageously designed as a medium-pressure turbine part and/or as a low-pressure turbine part. The low-pressure turbine part can also be designed as an accompanying, further turbine casing (multiflow). If, for example, two second turbine parts are provided, a medium-pressure turbine part is advantageously arranged downstream of the first turbine part and one or more low-pressure turbine parts are advantageously arranged downstream of the medium-pressure turbine part.

The steam turbine is characterized by the following features:

Between the first turbine part and the second turbine part, an additional sealing shell, also referred to as partition, is arranged in the turbine casing, in particular on the inner side of the turbine outer casing. The sealing shell is sealed toward the turbine shaft via sealing elements, for example brush or labyrinth seals.

In the first turbine part, a first inner casing is arranged rotationally symmetrically about the and sealed with respect to the turbine shaft on the inner side of the outer wall, that is to say on that side of the outer wall which faces the turbine shaft. The first inner casing has a first sealing region. The first sealing region divides the first turbine part with respect to the expansion direction into a front part and a rear part. Furthermore, the first inner casing has a first blade region which is parallel or approximately parallel to the turbine axis.

A first guide vane blading is arranged on the inner wall of the first blade region, which inner wall faces the turbine shaft. A first rotor blading corresponding to the first guide vane blading is arranged on the turbine shaft. The first guide vane blading and the first rotor blading form a first blading drum.

In the second turbine part, a second inner casing is arranged rotationally symmetrically about the and sealed with respect to the turbine shaft on the inner side of the outer wall. The second inner casing has a second sealing region which divides the second turbine part with respect to the expansion direction into a front part and a rear part. Furthermore, the second inner casing has a second blade region.

A second guide vane blading is arranged on the inner wall of the second blade region of the second inner casing, which inner wall faces the turbine shaft. A second rotor blading corresponding to the second guide vane blading is correspondingly arranged on the turbine shaft. The second guide vane blading and the second rotor blading form a second blading drum.

The blade regions of the inner casings each extend away from the respective sealing regions counter to the expansion direction. This means, the first blade region of the first inner casing extends away from that side of the first sealing region of the first inner casing which faces away from the sealing shell.

The steam turbine has at least one fresh steam line through which fresh steam can be guided from outside the turbine casing by the outer wall of the turbine casing and by the first blade region of the first inner casing into the region between the first blade region and the first sealing region, the turbine shaft and the first blading. The outer wall and the first blade region have openings for the connection of the fresh steam line. The fresh steam line is fastened to the first inner casing. The fresh steam line is guided in a sealed manner through the opening in the outer wall of the turbine casing.

The inner casings can be connected to the turbine casing via webs. It is conceivable for the inner casings to be formed integrally, in particular monolithically, with the turbine casing.

The sealing regions have, in the region facing the outer wall, respective openings through which steam can pass from the front part in each case into the respective rear part of the turbine parts. This means, the openings are arranged on the radially outer region of the sealing regions of the inner casings, in the vicinity of the outer wall of the turbine casing.

At least one first intermediate steam opening, in which an intermediate steam line is arranged, is provided in the outer wall of the turbine casing, in the region of the rear part of the first turbine part. "Cold" steam can be guided out of the rear part of the first turbine part via said intermediate steam line and fed to an externally arranged superheater.

Furthermore, a further intermediate steam opening is provided in the outer wall of the turbine casing. Said intermediate steam opening is arranged in the outer wall in the region of the second inner casing. Via a second intermediate steam line, which is guided through the intermediate steam opening, superheated steam can be guided through the outer wall of the turbine casing and through the second blade region of the second inner casing into the region between the second blade region and the second sealing region, the turbine shaft and the second blading. The superheated steam comes from the externally arranged superheater.

Furthermore, at least one steam outlet opening or a steam outlet line is provided in the outer wall of the turbine casing. Exhaust steam from the rear part of the second turbine part can be guided out of the turbine casing via the steam outlet line.

In the case of a steam turbine of this type with resuperheating, greatly superheated steam is conducted into the steam turbine at two points.

The steam turbine has a two-shell design by means of the two inner casings in the region in which the fresh steam and the resuperheated steam are introduced. That is to say, a first inner casing is inserted into the turbine casing in the first turbine part and a second inner casing is inserted into the turbine casing in the second downstream turbine part. The first inner casing shields the turbine casing, in particular the outer wall of the turbine casing, from the high temperatures of the inflowing fresh steam. The second inner casing shields the turbine casing, in particular the inner wall of the turbine casing, from the high temperatures of the resuperheated steam. At the same time, the pressure difference is divided between two pressure stages and therefore permits very high steam parameters in the inner casings.

The second inner casing, which is arranged in the region in which the resuperheated steam is introduced, is a dedicated component which is separated from the first inner casing in the region of the fresh steam inflow. It is therefore possible to design the turbine interior and the expansion run in variable form and to arrange the two inner casings counter to the main expansion direction such that the thrust in the steam turbine can be virtually completely compensated for.

Furthermore, by means of the arrangement and configuration of the two inner casings, the latter are in each case flowed around on all sides by large amounts of steam and thereby ensure a uniform temperature field. By means of a uniform temperature distribution on the outer wall of the turbine casing, curvature of said outer wall can therefore be minimized.

A particular advantage emerges from the free arrangement of inner casings since the sealing system of the turbine can therefore be optimized to minimum leakage losses. The unidirectional expansion direction of the two inner casings means that the sealing shell is required between the first turbine part and the second turbine part. Said sealing shell is loaded exclusively by the pressure differential between the cold and the hot line to and from the resuperheating. Therefore, there is virtually no leakage in the region of the sealing shell.

In the steam turbine, the first inner casing is located in the first turbine part in the expansion direction of the steam. The fresh steam flows into said first inner casing via the fresh steam line. The first blading can have a plurality of blading drums. A blading drum has guide vane blading and rotor blading in each case. The fresh steam is expanded counter to the main expansion direction of the steam through the steam turbine. This gives rise to two positive effects. First of all, the first inner casing is cooled by the colder steam flowing therearound and the overall thrust of the turbine is reduced since a counterthrust builds up in said region. In addition, a further drum blading can be arranged in the rear part of the first turbine part downstream of the inner casing. The expansion run is subsequently interrupted by the sealing shell. The cold resuperheating steam in the rear part of the first turbine part is guided completely out of the turbine and resuperheated in the superheater, in particular in a steam boiler. The superheated steam subsequently flows back into the steam turbine in the second turbine part. The steam is very hot at this point, and therefore the strength of a single-shell turbine casing would be exceeded. The steam is therefore conducted into the second inner casing. In said second inner casing, the superheated steam is expanded until it has reached a temperature permissible for the turbine casing, in particular the outer wall of the turbine casing.

By means of the expansion of the fresh steam in the first blading within the first inner casing and the expansion of the superheated steam in the second blading within the second inner casing, the pressure and the temperature in the region between the inner casings and the outer wall of the turbine casing are in each case lower than within the inner casings. By this means, the turbine outer casing is subjected to less loading. This ensures that the turbine casing or the outer wall of the turbine casing is curved only a little, if at all, during operation of the steam turbine. The effect achieved by the specific arrangement and configuration of the inner casings and of the blading in the inner casings is that no extreme pressure and temperature parameters prevail upstream and downstream of the sealing shell in the expansion direction, and therefore leakages through the sealing elements of the sealing shell are small.

The second inner casing with the second blading, like the first inner casing of the first blading, is inserted counter to the expansion direction with the steam. This results in the same positive effects as in the case of the first inner casing, namely improved cooling of the outer side of the second inner casing and of the inner side of the outer wall of the turbine casing, and also thrust compensation. Since the thrust compensation effects accumulate, the effect is considerably reinforced, which has a positive effect on storage losses and on the size of a low-pressure part which is optionally insertible into the turbine casing and is arranged downstream in the expansion direction.

The second inner casing is cooled by the steam flowing therearound.

By means of the use of the two inner casings, a steam turbine, which is normally entirely in the form of two shells, can be formed with a turbine casing which, for the most part, has a single shell. The structural outlay on construction of the steam turbine is thereby considerably reduced. If a low-pressure part is arranged downstream of the medium-pressure part, that is to say the second turbine part, it is possible, on account of the two inner casings, to arrange a complete condensation turbine system with resuperheating within a single turbine casing.

A superheater is arranged outside the turbine casing of the steam turbine, said superheater being designed for superheating the "cold" steam emerging from the first intermediate steam line and for transmitting the steam superheated in the superheater to the second intermediate steam line.

In order to obtain particularly good expansion of the steam in the first turbine section, it can be provided in a steam turbine that at least one third blading with a guide vane blading on the inner side of the outer wall and with a corresponding rotor blading on the turbine shaft is arranged in the rear part of the first turbine part. Said third blading is not arranged between the inner wall of the blade region of the first inner casing and the turbine shaft, but rather between the outer wall of the turbine casing and the turbine shaft.

By means of the unidirectional arrangement of the inner casings, that is to say the blade regions of the inner casings, and the additional sealing shell, the third blading can be installed between the first inner casing and the sealing shell. Said third blading likewise relieves the pressure on the sealing shell. The possibility of fitting a further blading exists, however, only within the technically manageable parameters of the single-shell casing region.

Furthermore, it can be provided in a steam turbine that a fourth blading with a guide vane blading on the inner side of the outer wall and a corresponding rotor blading on the turbine shaft is arranged in the rear part of the second turbine part. Further expansion of the steam conducted through the steam turbine can also be undertaken once again by said further blading. This makes it possible once again to reduce the loading in this region on the turbine casing. Therefore, a steam turbine is advantageous, in which a third turbine part, in particular a low-pressure turbine part, is arranged in the rear part of the second turbine part or downstream of the rear part of the second turbine part in the expansion direction.

It can be provided in a steam turbine that the first turbine part is a high-pressure turbine part and the second turbine part is a medium-pressure turbine part or a low-pressure turbine part.

In order to avoid leakages on the inner casings, the sealing regions of the inner casings are sealed with respect to the turbine shaft via sealing elements. This can take place, for example, via brush or labyrinth seals.

BRIEF DESCRIPTION OF THE DRAWINGS

The present invention is explained in detail with reference to the attached figures of the drawing, in which, in each case schematically.

DETAILED DESCRIPTION OF INVENTION

In FIGS. 1 to 4, elements having the same function and manner of operation are in each case provided with the same reference signs.

Figure 1:
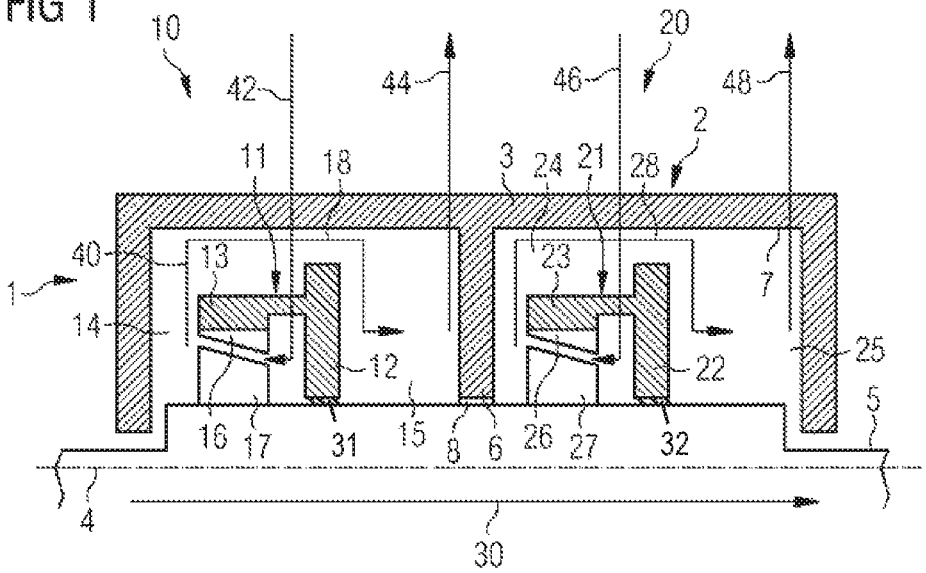
FIG. 1 shows the run of the steam in a first embodiment of a steam turbine according to the invention.
Figure 2:
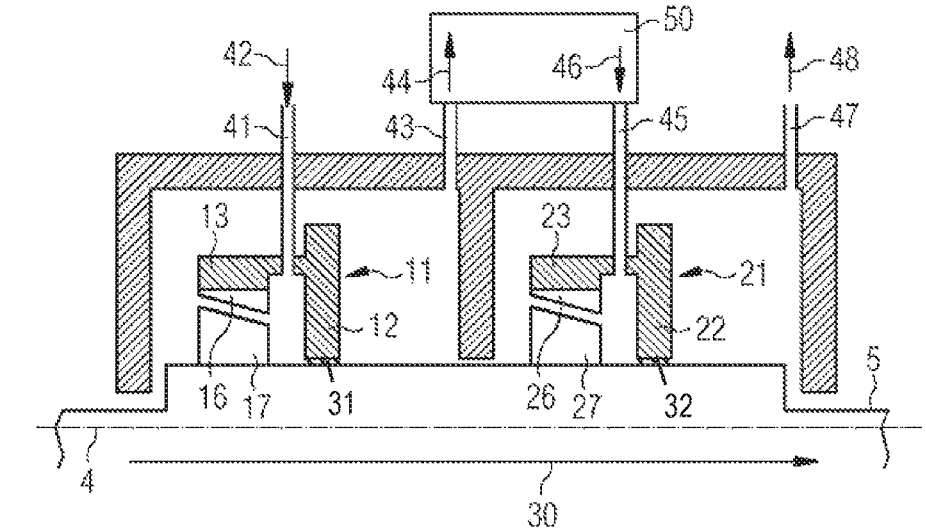
FIG. 2 shows steam lines through the turbine casing of the steam turbine according to FIG. 1.
Figure 3:
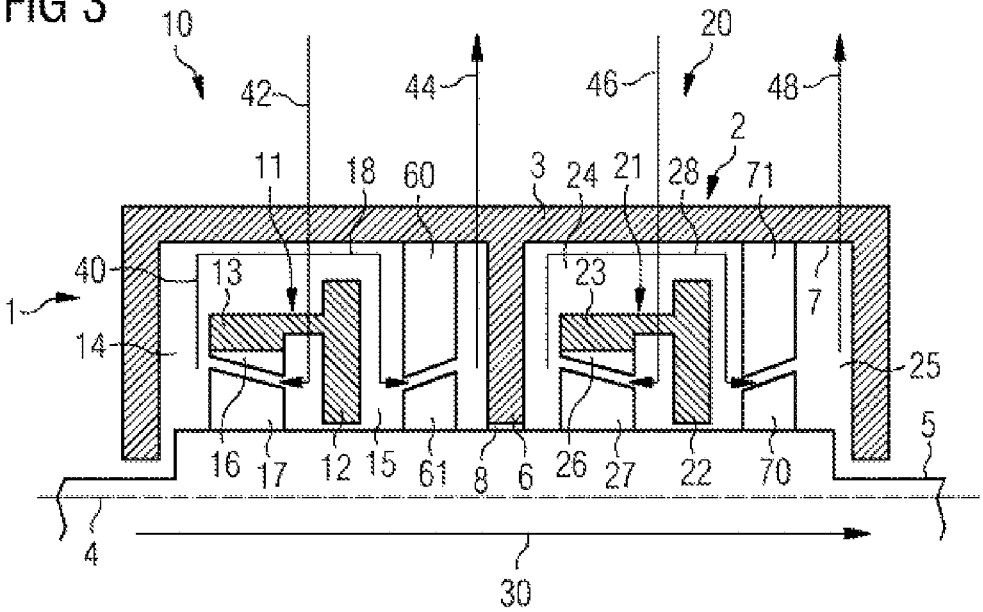
FIG. 3 shows the run of the steam in a second embodiment of a steam turbine according to the invention.
Figure 4:
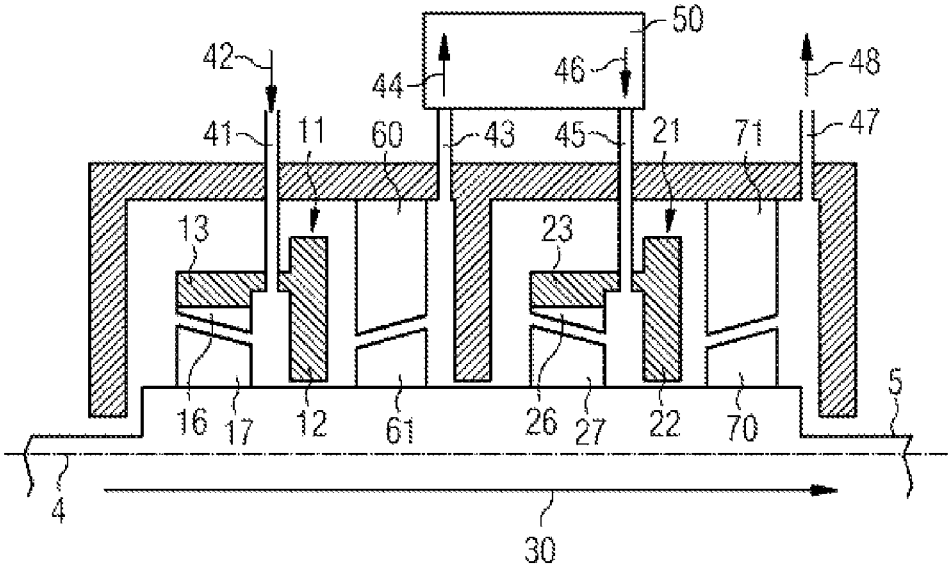
FIG. 4 shows steam lines through the turbine casing of the steam turbine according to FIG. 3.

FIG. 1 schematically illustrates the run of the steam 40 in a first embodiment of a steam turbine 1 according to the invention. Fresh steam 42 flows from outside the turbine casing 2 through a fresh steam line 41 into the interior of the first inner casing 11. The first inner casing 11 is arranged in the first turbine part 10, which is advantageously a high-pressure part. The first inner casing 11 has a first sealing region 12 and a first blade region 13. The first sealing region 12 extends perpendicularly to the turbine axis 4 and is sealed with respect to the turbine shaft 5 via a sealing element 31. This first sealing region divides the first turbine part 10 into a front part 14 and a rear part 15. The first blade region 13 extends away from the first sealing region 12 parallel to the turbine axis 4 counter to the main expansion direction 30 of the steam 40 through the steam turbine 1. A first guide vane blading 16 is arranged on that side of the first blade region 13 which faces the turbine shaft 5. In a manner corresponding to said first guide vane blading, a correspondingly designed first rotor blading 17 is arranged on the turbine shaft 5. The first guide vane blading 16 and the first rotor blading 17 together form a first blading or blading drum. The fresh steam 42 flowing into the first inner casing 11 is guided by the first blading 16, 17, that is to say counter to the actual expansion direction 30 of the steam 40. The fresh steam 42 expands in the process. The pressure and the temperature of the fresh steam decrease in the first blading 16, 17, and therefore the pressure and the temperature are lower in the front part 14 of the first turbine part 10 than prior to the expansion by means of the first blading 16, 17. The expanded steam 40 flows completely around the first inner casing 11 and thereby cools the latter. The loading of the outer wall 3 of the turbine casing 2 is likewise reduced by the expansion of the fresh steam 42 within the first inner casing 11. The expanded fresh steam flows along the outer side of the first blade region 13 and is conducted to the rear part 15 of the first turbine part 10 through openings 18 in the first sealing region 12 or through openings 18 between the first sealing region 12 and the outer wall 3 of the turbine casing 2. In said rear part 15, the steam 40 is cooled and the pressure of the steam 40 is reduced.

The first turbine part 10 is separated from the second turbine part 20 by a sealing shell 6. The sealing shell 6 extends between the outer wall 3 of the turbine casing 2 and the turbine shaft 5. The sealing shell 6 is sealed here with respect to the turbine shaft 5 by means of sealing elements 8. The cooled expanded steam 44 is guided out of the rear part 15 through the turbine casing 2 by a first intermediate steam line 43 to an external superheater 50, see FIG. 2. In the superheater 50, the steam is superheated and supplied again to the second turbine part 20. That is to say, the superheated steam 46 is conducted through the turbine casing 2 by a second intermediate steam line 45 into the interior of the second inner casing 21, which is arranged in the second turbine part 10. A second blading 26, 27 is provided within the second inner casing 21. The second inner casing 21 is constructed similarly or identically to the first inner casing 11. A second sealing region 22 of the second inner casing 21 extends perpendicularly to the turbine axis 4 and is sealed with respect to the turbine shaft 5 via a sealing element 32. A second blade region 23 is arranged on the second sealing region 22, which blade region extends from said sealing region counter to the main expansion direction 30 of the steam 40 through the steam turbine 1. The superheated steam 46 is expanded by the second blading 26, 27 and fed to the front part 24 of the second turbine part 20. The second sealing region 22 of the second inner casing separates the front part 24 from the rear part 25. The expanded steam 40 cools both the second inner casing 21 and the outer wall 3 of the turbine casing 2. The loadings on the single-shell turbine casing 2 are thereby reduced. Via openings 28 in the second sealing region 22 or via openings between the second sealing region 22 and the outer wall 3 of the turbine casing 2, the expanded steam 40 passes into the rear part 25 of the second turbine part 20. From there, the cooled, wet exhaust steam 48 can be removed from the turbine casing via a steam outlet line 47.

By means of the specific configuration and arrangement of the two inner casings 11, 21, the thrust in the steam turbine 1 can be virtually completely compensated for. The first inner casing 11 is cooled by the colder steam 40 flowing therearound and the overall thrust of the steam turbine 1 is reduced as a counterthrust builds up in this region.

Downstream of the first inner casing 11, a further drum blading with a guide vane blading 60 and a rotor blading 61 can additionally be arranged in the rear part 15 of the first turbine part 10. By this means, the steam 40 expands further. The expansion run is subsequently interrupted by the sealing shell 6. The cold resuperheating steam 44 in the rear part 15 of the first turbine part 10 is completely guided out of the steam turbine 1 and resuperheated in the superheater 50. Subsequently, the superheated steam 46 flows back into the steam turbine 1 into the second turbine part 20. The steam 46 is very hot at this point. Therefore, the superheated steam 46 is conducted into the second inner casing 21. The superheated steam 46 is expanded in said second inner casing 21 until the steam has reached a temperature permissible for the turbine casing 2, in particular for the outer wall 3 of the turbine casing 2. A further blading 70, 71 can additionally be arranged in the rear part 25 of the second turbine part 20, see FIGS. 3 and 4. Said blading can be arranged between the outer wall 3 and the turbine shaft 5.

The invention claimed is:

1. A steam turbine, comprising a turbine casing with an outer wall, a turbine shaft mounted rotatably about a turbine axis in the turbine casing, a first turbine part, and a second turbine part which is arranged downstream of the first turbine part in an axial direction of the turbine shaft, wherein an expansion direction for steam conducted through the steam turbine runs from the first turbine part to the second turbine part, between the first turbine part and the second turbine part, a sealing shell arranged on the turbine casing said sealing shell being formed in a sealing manner with respect to the turbine shaft via a sealing element, in the first turbine part, a first inner casing arranged rotationally symmetrically about the first turbine part and sealed with respect to the turbine shaft on an inner side of the outer wall, wherein the first inner casing has a first sealing region which is perpendicular or approximately perpendicular to the turbine axis and divides the first turbine part with respect to the expansion direction into a front part and a rear part, and has a first blade region which is parallel or approximately parallel to the turbine axis, a first guide vane blading arranged on an inner wall of the first blade region which faces the turbine shaft, and a first rotor blading corresponding to the first guide vane blading arranged on the turbine shaft, in the second turbine part, a second inner casing arranged rotationally symmetrically about the second turbine part and sealed with respect to the turbine shaft on the inner side of the outer wall, wherein the second inner casing has a second sealing region which is perpendicular or approximately perpendicular to the turbine axis and divides the second turbine part with respect to the expansion direction into a front part and a rear part, and has a second blade region which is parallel or approximately parallel to the turbine axis, a second guide vane blading arranged on an inner wall of the second blade region which faces the turbine shaft, and a second rotor blading corresponding to the second guide vane blading arranged on the turbine shaft, wherein the first and second blade regions of the first and second inner casings each extend from their respective sealing regions counter to the expansion direction, wherein fresh steam can be guided via at least one fresh steam line through the outer wall of the turbine casing and through the first blade region of the first inner casing into a region between the first blade region and the first sealing region, wherein the first and second sealing regions each have, in a respective region facing the outer wall, respective openings through which steam can pass from the front part into the rear part of each respective turbines part, wherein cold steam can be guided out of the rear part of the first turbine part via at least one first intermediate steam line, wherein superheated steam can be guided via at least one second intermediate steam line through the outer wall of the turbine casing and through the second blade region of the second inner casing into a region between the second blade region and the second sealing region, and wherein exhaust steam from the rear part of the second turbine part can be guided out of the turbine casing via at least one steam outlet line through the outer wall.

2. The steam turbine as claimed in claim 1, further comprising:

at least one third blading with a guide vane blading on the inner side of the outer wall and with a corresponding rotor blading on the turbine shaft arranged in the rear part of the first turbine part.

3. The steam turbine as claimed in claim 2, further comprising:

a fourth blading with a guide vane blading on the inner side of the outer wall and a corresponding rotor blading on the turbine shaft arranged in the rear part of the second turbine part.

4. The steam turbine as claimed in claim 1, further comprising:

a third turbine part arranged in the rear part of the second turbine part or downstream of the rear part of the second turbine part in the expansion direction.

5. The steam turbine as claimed in claim 1, wherein the first turbine part is a high-pressure turbine part and the second turbine part is a medium-pressure turbine part or a low-pressure turbine part.

6. The steam turbine as claimed in claim 1, wherein the sealing regions are sealed with respect to the turbine shaft via sealing elements.

7. The steam turbine as claimed in claim 1, wherein the sealing shell is arranged on the turbine casing on the inner side of the outer wall.

8. The steam turbine as claimed in claim 4, wherein the third turbine part comprises a low-pressure turbine part.

9. A steam turbine comprising:

an outer casing containing a steam flow path having a main expansion direction;

a shaft rotatably supported within the outer casing;

an inner casing disposed between the outer casing and the shaft;

the inner casing comprising a sealing region in a sealed relationship with the shaft, the sealing region defining a front part and a rear part of the steam flow path relative to the main expansion direction;

the inner casing further comprising a blade region extending from the sealing region in a direction counter to the main expansion direction such that steam passing through blading of the blade region moves in the direction counter to the main expansion direction; and the sealing region defining an opening through which the steam, after having passed through the blading, can pass from the front part to the rear part in the main expansion direction.

10. The steam turbine of claim 9, further comprising a fresh steam line passing through the outer casing and the inner casing and configured to deliver the steam as fresh steam to a region inside the inner casing without exposing an inner surface of the outer casing to the fresh steam.

11. The steam turbine of claim 10, further comprising a first intermediate steam line passing through the outer casing and configured to exhaust the steam from the rear part of the steam flow path after the steam has passed through the blading, such that the inner surface of the outer casing is exposed only to the steam having passed through the blading and having a reduced pressure and temperature compared to the fresh steam.

12. The steam turbine of claim 11, further comprising:

a heater disposed outside the outer casing and having an inlet in flow communication with the first intermediate steam line and operable to reheat the reduced pressure and temperature steam; and a second intermediate steam line in flow communication with an outlet of the heater for delivering the reheated steam to a second turbine part of the steam turbine.

13. The steam turbine of claim 9, further comprising a drum blading arrangement comprising a guide vane blading and a rotor blading arranged in the rear part of the steam flow path.

* * * * *